United States Patent [19]

Bustos

[11] Patent Number: 4,461,388

[45] Date of Patent: Jul. 24, 1984

[54] SLIP SURFACE SHELF MERCHANDISER

[75] Inventor: Rafael T. Bustos, Atlanta, Ga.

[73] Assignee: Leggett & Platt, Incorporated, Carthage, Mo.

[21] Appl. No.: 247,346

[22] Filed: Mar. 25, 1981

Related U.S. Application Data

[63] Continuation-in-part of Ser. No. 129,342, Mar. 11, 1980, Pat. No. 4,346,806.

[51] Int. Cl.[3] ..... A47F 1/00

[52] U.S. Cl. ..... 211/49 D; 211/184

[58] Field of Search ..... 248/346; 108/51.3; 211/49 D, 49 S, 184; 428/186, 182, 183; 156/210, 205

[56] References Cited

U.S. PATENT DOCUMENTS

| | | | |
|---|---|---|---|
| 2,111,496 | 3/1938 | Scriba | 211/49 D |
| 3,432,859 | 3/1969 | Jordan et al. | 156/205 X |
| 3,839,137 | 10/1974 | Davis et al. | 428/183 |
| 4,136,783 | 1/1979 | Karashima | 211/49 D |
| 4,267,223 | 5/1981 | Swartz | 428/186 X |
| 4,284,259 | 8/1981 | McCaskill | 248/346 |
| 4,314,648 | 2/1982 | Spamer | 211/49 D |

FOREIGN PATENT DOCUMENTS

| | | | |
|---|---|---|---|
| 2816999 | 10/1979 | Fed. Rep. of Germany | 211/49 D |
| 2093403 | 9/1982 | United Kingdom | 428/182 |

*Primary Examiner*—Ramon S. Britts
*Assistant Examiner*—Robert W. Gibson, Jr.
*Attorney, Agent, or Firm*—Wood, Herron & Evans

[57] ABSTRACT

A merchandiser for converting a shelf having a generally horizontal top surface into a shelf having downwardly and forwardly sloping low friction top surface for gravity feeding columns of items of merchandise such as plastic bottles one after another to the front of the shelf as the forwardmost items on the shelf are successively removed by customers.

19 Claims, 9 Drawing Figures

SLIP SURFACE SHELF MERCHANDISER

This application is a continuation-in-part of application Ser. No. 129,342 filed Mar. 11, 1980, now U.S. Pat. No. 4,346,806, issued Aug. 31, 1982 and assigned to the assignee of this application.

This invention relates to display racks. More particularly this invention relates to an improved display rack of the gravity feed type.

Display racks are often used in supermarkets and other types of stores to display items of merchandise generally handled as self-service items. For example, display racks are often used in supermarkets to display cans or bottles of soft drinks, the cans or bottles being removable for purchase by the customer in a self-service manner from the display rack.

A common problem encountered in all self-service display racks is that of constantly moving merchandise forwardly on the shelf of the rack as the forwardmost objects or items of merchandise are removed from the shelf. Traditionally, supermarkets have had stock clerks who regularly move through the store placing new stock on the shelves or moving older stock forwardly on the shelf so as to make it more easily accessible to the customers.

To minimize the need for stock clerks to move merchandise forwardly on the store shelves, there have been numerous display racks developed for self-feeding merchandise forwardly on the shelf. In general, most of these display rack structures incorporate slanted or sloped shelves on which the merchandise is displayed. When the forwardmost object in a given column of objects on a self-feeding shelf is removed, gravity causes the objects behind that front item to move forwardly in the column until stopped at the front edge of the shelf. Typical gravity feed shelf assemblies of this type are illustrated in Pendergrast U.S. Pat. No. 3,203,553 and Shield U.S. Pat. No. 2,443,871. These two patents disclose gravity feed can racks in which the cans are disposed with their axes horizontal so that the rear can on the shelf can roll down the sloped shelf in response to removel of the lead can in a column. Another type of gravity feed shelf assembly is described in Bergstedt U.S. Pat. No. 3,279,618. In the Bergstedt patent, cans having the axis of the can disposed in a vertical plane slide down a sloped shelf structure to the front edge thereof.

More recently I have developed and disclosed in U.S. Pat. No. 4,128,177 a shelf assembly including a conveyor belt oriented with the top surface of the belt in a downwardly sloping plane and movable over a low friction surface for supporting bottles or cans with the bottoms of the bottles or cans supported on the top surface of the belt. The use of the belt enables all of the bottles or cans to move together forwardly when the forwardmost bottle or can on the belt is removed. The use of the belt precludes the bottles slipping forward one at a time on the shelf and thereby prevents the bottles from impacting one against another as the bottles sequentially move forward in the column and are arrested by a shelf abutment after a customer removes the lead container. The use of this belt construction enables the gravity feed shelves to be used with glass bottles which otherwise cannot be safely used on self-feeding gravity feed display shelves because of the frequent occurrence of breakage which results from the sliding bottles impacting with one another.

In recent years there has been a trend toward bottling soft drink beverages in plastic bottles which are not subject to breakage or damage when impacted one against another. This trend has eliminated the need for gravity feed belts as in my U.S. Pat. No. 4,128,177 for feeding beverage bottles forwardly on a display case whenever the display case is used exclusively for displaying plastic bottles.

There has been a long standing need for a device for converting horizontal shelves to sloping gravity feed shelves so as to enable conventional longitudinal shelves to be converted from shelves which require objects to physically be moved forwardly on the shelf as the forwardmost objects are removed, to shelves which are self-feeding of the displayed objects to the forward edge of the shelf. The invention of this application is concerned with meeting that need. To that end it has therefore been an objective of this invention to provide a merchandiser which may be fitted atop a conventional horizontal shelf so as to convert that shelf to a self-feeding gravity feed shelf.

The device of this invention which accomplishes this objective is particularly intended to be used on shelves of beverage display cases wherein beverage bottles are displayed and are automatically fed forward on the shelves as the forwardmost bottles on the shelves are removed by customers. It comprises a generally wedge-shaped metal frame which supports a sheet of three ply corrugated plastic, the top surface of which is made from high density polyethylene mixed with 15% silicone to provide a high slip or low friction surface on the top of the sheet. The corrugations of the sheet run from front to rear of the merchandiser so as to define vertical ribs over which the merchandise slides in the course of being gravity fed forwardly on the shelf. The front and rear edges of the corrugated sheet are scored and bent upwardly into a vertical plane so that column defining organizer wires and bumper wires may be mounted within apertures defined by the corrugations of the plastic sheet.

The primary advantage of this invention is that it provides an inexpensive device or so-called merchandiser which may be added to store shelves and particularly to beverage display case shelves to convert those shelves to self-feeding gravity flow shelves. This invention also has the advantage of being easily mounted on existing merchandise display shelves without the need of any special tools so that conversion may easily be effected by store personnel.

These and other objects and advantages of this invention will be more readily apparent from the following description of the drawings in which.

Figure 1:
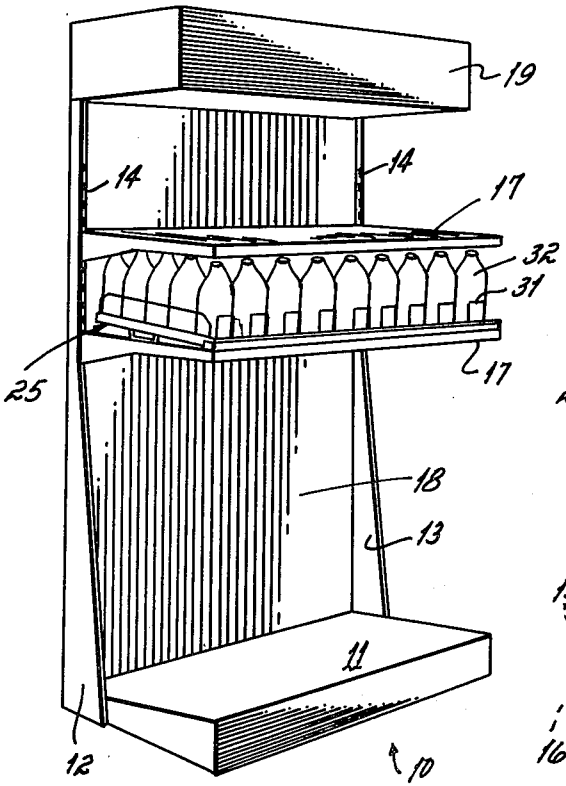
FIG. 1 is a perspective view of a beverage bottle display case having the inventive merchandiser of this invention mounted on one shelf.
Figure 3:
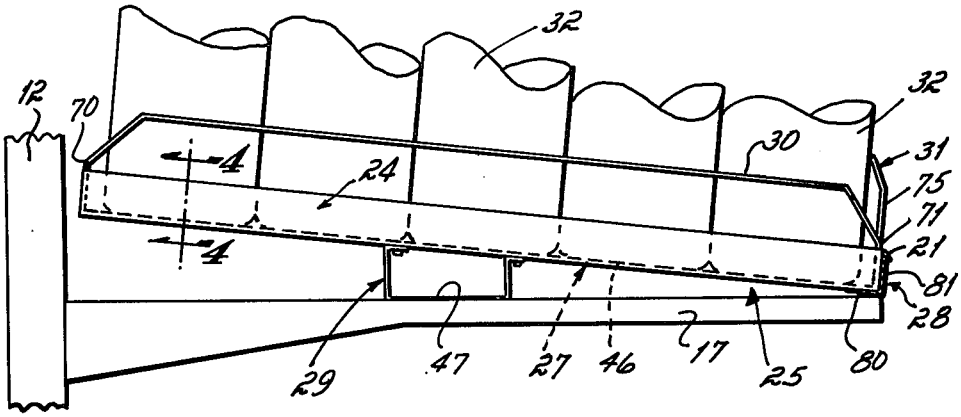
FIG. 3 is a side elevational view of the merchandiser of this invention.
Figure 4:
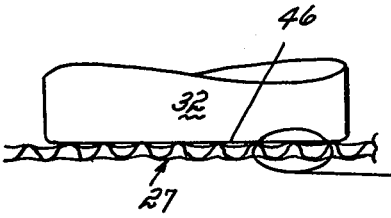
FIG. 4 is a cross sectional view taken on line 4—4 of FIG. 3.
Figure 5:
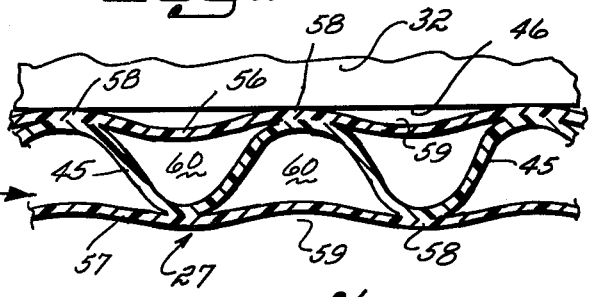
FIG. 5 is an enlarged cross sectional view of the encircled portion of FIG. 4.

Referring first to FIG. 1, there is illustrated a conventional beverage display case or so-called gondola rack 10 of the type commonly used for many years for displaying beverage bottles in a store or retail establishment. This display case comprises a conventional wedge-shaped base 11 to which are attached side posts 12 and 13. The front edge of these posts 12 and 13 define spaced vertical slots 14 adapted to receive tabs 15, 16 of shelf mounting brackets for removable securement of the shelves 17 upon the post. A back panel 18 conventionally spans the area between the side post 12 and 13 and serves as a brace for those posts. The top of the display case supports a header 19 upon which advertising material is generally displayed.

In FIG. 1 the display case is illustrated as having two shelves 17, the top surface of which is located in a horizontal plane. Conventionally, there are as many shelves mounted upon display racks of this type as may be placed thereon to optimize the capacity of the stand or rack for supporting bottles of varying sizes.

The display case 10 heretofore described has long been in public use and per se forms no part of the invention of this application. The invention of this application rather resides in a merchandiser 25 for converting the shelf 17 from one having a top horizontal surface into a shelf having a downwardly and forwardly sloping low friction top surface over which displayed merchandise will slide forwardly whenever the forwardmost item of merchandise in a column of items is removed from the shelf.

The merchandiser 25 of this invention comprises a shelf frame 26, a slip surface insert 27 adapted to be supported by the shelf frame 26, and a frame retainer bracket 28 for securing the frame onto the top horizontal surface of the shelf 17. The merchandiser also includes a series of organizer wires 30 mounted above the slip surface insert 27 for spacing objects supported upon the insert in columns, and bumper wires 31 engageable by displayed bottles 32 as they slide forwardly on the shelf so as to resiliently stop the bottles 32 at the front of the shelf and prevent them from sliding off of and over the front edge of the shelf.

The shelf frame 26 comprises a rectangular frame 24 and a frame base 29 secured to the rectangular frame 24 so as to mount it in an angularly downwardly and forwardly sloping plane.

The rectangular frame 24 is manufactured from four right angle channels 40, 41, 42, 43. Each of these channels has a vertical leg 22 and a horizontal leg 23. These horizontal legs overlap at the end and are spot welded (not shown) so as to secure the four channels in an assembled rectangular configuration.

Front and rear channels 41, 43 have a generally J-shaped hook section 21 which extends outwardly from the top of the vertical legs 22 of the channels. As explained more fully hereinafter, the hook shaped lip 21 on the front channel functions to assist in maintaining the frame 26 on the shelf 17.

Figure 2:
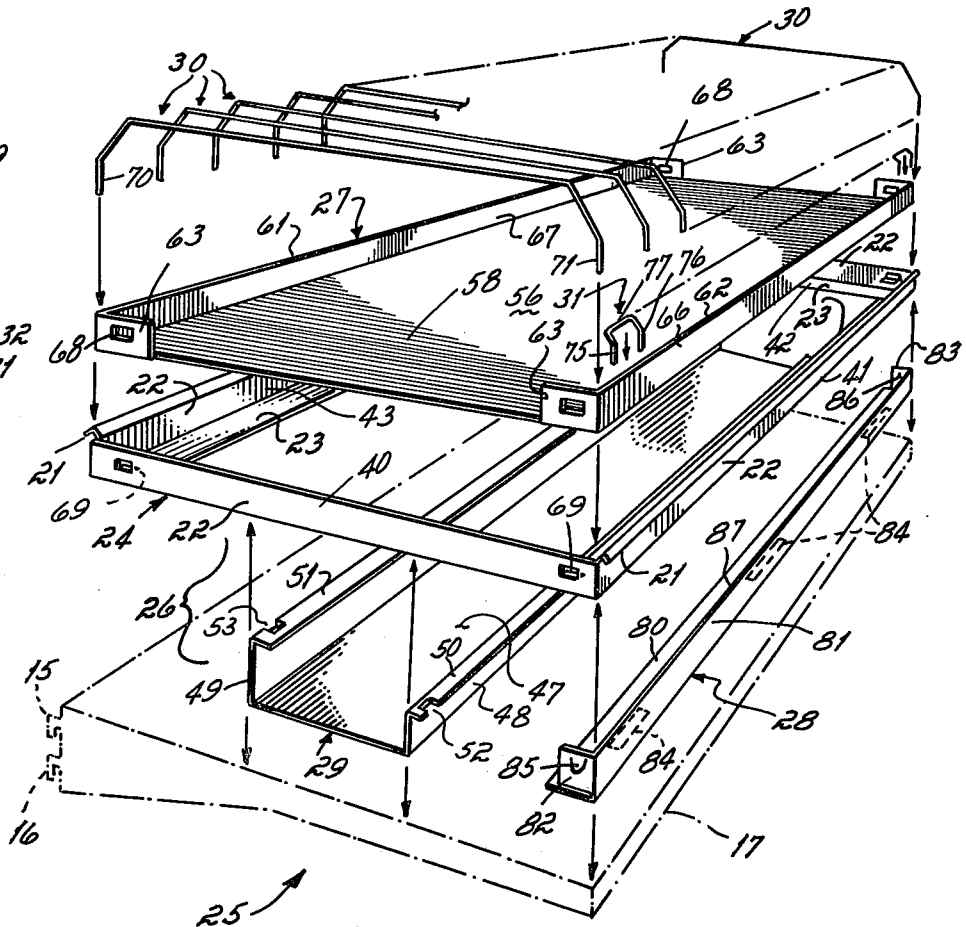
FIG. 2 is an exploded perspective view of the merchandiser illustrated in FIG. 1.
Figure 6:
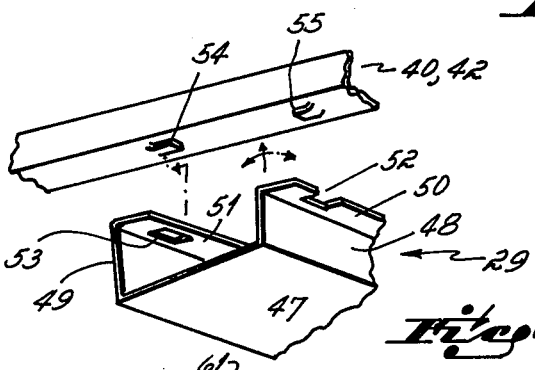
FIG. 6 is a perspective view of a portion of the merchandiser illustrating the technique for attaching the merchandiser frame base to the merchandiser rectangular frame.

The frame base 29 is formed from a generally U-shaped channel of metal cut to the width of the rectangular frame 28. The base frame 29 has two legs 48, 49 which extend upwardly from a bottom section 47. The top of each leg 48, 49 is bent forwardly to form flanges 50, 51 by means of which the frame base is attached to the rectangular frame 28. With reference to FIGS. 2 and 6 it will be seen that the forwardmost flange 50 has a notch 52 cut into it at each end. The rearward flange 51 has a hole 53 cut in it at each end. To secure the base frame 29 to the side channels 40, 42 of the rectangular frame 24, the hole 53 of the rear leg flange 50 is received under a tab 54 punched from the bottom surface of the legs of the channels 40, 42. The notches 52 of the front legs are bent rearwardly and slip under a tab 55 punched from the same channels 40, 42. The tabs 54, 55 form hooks which face in opposite directions and which cooperate with the holes 53 and notches 52 of the base channel to lock the frame base 29 to the side channels 40, 42. The base channel could though, rather than being assembled by tabs and notches in the channels, be assembled by conventional spot welds or any form of conventional connector.

Figure 7:
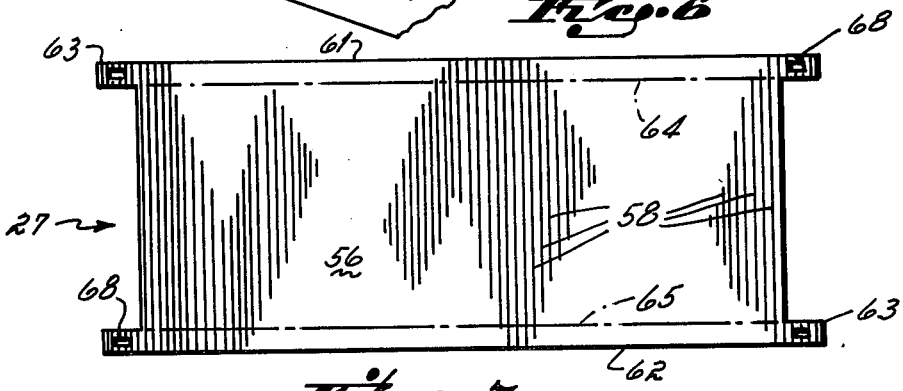
FIG. 7 is a top plan layout view of the slip surface insert employed in the merchandiser of this invention.

With reference now to FIGS. 2 and 7 it will be seen that the top surface of the merchandiser is formed by the slip surface insert 27 which is placed within the rectangular frame and is supported upon the horizontal legs 23 of the channels 40, 41, 42 and 43. The insert 27 is manufactured from a sheet of three ply corrugated plastic material. This plastic corrugated material is manufactured from a sinusoidal shaped or wave shaped sheet of extruded plastic material 45 sandwiched between a generally planar bottom sheet 56 and top sheet 57. The top and bottom sheets are extruded in a planar configuration and are assembled onto the wave shaped or sinusoidal shaped sheet while the extruded plastic of the three plies is still in a semi-molten state. As a consequence of this technique of assembling the three plies, the semi-molten material of the three plies flows together and fuses into a unitary extruded configuration having raised rib sections 58 located at the points at which the top and bottom layers contact the central wave shaped ply and having valleys or recesses 59 formed between the ribs. Pockets 60 are formed by the corrugations of the three ply product and extend parallel to the ribs 58. When the insert is cut to the configuration illustrated in top plan view in FIG. 7, the corrugations or pockets 60 are oriented so that they extend from the rear edge 61 of the insert to the front edge 62. Similarly, the ribs which extend parallel to the corrugations are located in a front to rear orientation in the cut insert.

In a preferred embodiment of this invention, the three plies 45, 56 and 57 of the corrugated insert are each extruded from high density polyethylene. The top sheet though is mixed with 15% silicone before it is extruded as a sheet so as to provide a high slip or low friction slip surface on the top of the insert. Consequently, bottles or merchandise sliding on the top surface slides more easily with less friction between the bottom surface 46 of the bottles 32 and the top surface of the ribs 58 than is present if the top ply 56 of the corrugated material is formulated of the same polyethylene plastic as is the other two plies.

With reference now to FIG. 7 it will be seen that the insert 27 is generally rectangular in configuration and has tabs 63 extending outwardly from the front and rear edges. Additionally, the rectangular sheet is scored on the underside along the score lines 64, 65 which extend parallel to the front and rear edges of the sheet. The sheet is folded upwardly along these score lines 64, 65 so as to form vertical front and rear edge sections 66, 67 on the sheet. The tabs 63 on the front edge of the sheet are folded rearwardly and the tabs at the rear edge of the sheet are folded forwardly so that the assembled sheet may be fitted into the rectangular frame with the bottom of the sheet or insert 27 resting upon the top surface of the horizontal flanges of the channels. Each of the tabs 63 has a rectangular hole 68 cut into it for reception of a tab 69 punched from the vertical leg 22 of the side channels 40, 42. These tabs 69 secure the insert within the rectangular frame 24 and prevent its being inadvertently lifted from the frame.

In order to divide the merchandiser into columns of bottles 32, organizer wires 30 extend from the front edge of the merchandiser to the rear edge. These organizer wires are generally U-shaped in configuration and have downwardly extending vertical legs 70, 71 at their opposite ends. These legs are fitted into pockets 60 of the upwardly turned edge sections 66, 67 of the insert. When so inserted, the legs 70, 71 are fixed relative to the insert 27 and thus relative to the rectangular frame 24. In practice, the organizer wires are equidistantly spaced across the width of the merchandiser and are spaced apart a distance slightly greater than the diameter of the bottles 32. Thus, the organizer wires define as many columns as may be accommodated by the width of the shelf for a particular size bottle. When smaller or larger bottles are placed on the shelf, all that is required is to reposition the organizer wires in different pockets 60 of the corrugated sheet so as to define different width columns on the merchandiser.

When the bottles 32 stored on the merchandiser slide forwardly after removal of the forwardmost bottle in a column, there is a need for a bumper or stop to prevent the bottles from tipping over the front edge of the rectangular frame and falling out of the merchandiser. These bumpers comprise wires 31 bent into a U-shaped configuration. These bumper wires have downwardly extending legs 75, 76 received within pockets 60 of the front edge section 66 of the insert. The bumper wires 31 are spaced medially between each pair of organizer wires. In the preferred embodiment of the bumper wires 31, the tops are bent inwardly so that the top cross bar 77 of the bumper contacts bottles prior to the sliding bottles coming into contact with the vertical edge section 66 of the insert 27.

In commercial practice, the merchandiser 25 is to be shipped in a knocked-down condition with the rectangular frame 24, bracket 28, frame base 29, inserts 27, organizer wires 30, and bumper wires 31 all in a disassembled condition. When the merchandiser arrives at a store or location to be assembled onto a display rack, for example display rack 10, the frame base 29 is first assembled onto the rectangular frame 24 in the manner illustrated in FIG. 6; that is, by having the apertures 53 and notches 52 of the frame base inserted into the tabs 54, 55 of the rectangular frame channels 40, 42. The edge sections 66, 67 of the insert are then folded upwardly about the score lines 64, 65 and the end flaps 63 of those edge sections 66, 67 are folded inwardly. The insert is then placed into the rectangular frame 26 with the bottom surface of the insert resting upon the top surface of the horizontal legs 23 of the channels 40, 41, 42, 43 of the rectangular frame. When the insert is moved downwardly into the rectangular frame, the flaps 63 of the insert are pushed inwardly so that the flaps clear and pass over the inwardly bent tabs 69 of the rectangular frame. When the insert is fully seated within the rectangular frame, the tabs 69 extend into the aperture 68 of the flaps so as to secure the insert against inadvertent lifting from the rectangular frame. The organizer wires 30 are then positioned in the pockets 60 of the corrugated insert at locations equidistantly spaced across the width of the insert. The distance between the inserts is slightly greater than the width of the bottles or merchandise to be displayed on the shelf so that the organizers define columns extending front to rear on the merchandiser onto which the bottles will be inserted for display purposes. The bumper wires 31 are then inserted into pockets 60 in the upper front edge 66 of the insert at locations in the center of each column.

With the merchandiser thus fully assembled it is ready to be attached to a shelf 17. In the preferred embodiment, this attachment is accomplished by a frame retainer bracket 28. The retainer bracket comprises a sheet metal channel having a horizontal leg 80 and a vertical leg 81. The ends of the vertical leg 81 are turned inwardly to form side flanges 82, 83 on the retainer bracket. The flanges 82, 83 are spaced apart a distance equal to the width of the rectangular frame 24 so that the frame 24 may be fitted between these flanges.

On the bottom of the retainer bracket there are three pieces of conventional two-sided adhesive tape 84; that is adhesive tape which has adhesive on both surfaces. One of these surfaces is adhered to the horizontal flange 80 of the bracket and, when the bracket 24 is shipped, the other side is covered by conventional tear-away tape. When the tear-away tape is removed, the frame 28 may simply be placed on the top of the shelf and thereby adhered thereto. Alternatively, the retainer bracket may be secured to the shelf 17 by any form of securement, as for example conventional wood screws or sheet metal screws.

Once the retainer bracket is fixed on the shelf 17 by the two-way tape or other form of connector, the rectangular frame 24 is inserted into the bracket by vertical movement of the rectangular frame into the channel between the flanges 82, 83. As the rectangular frame moves downwardly into the channel, the end flanges 82, 83 are bent outwardly against the resilience of the metal of which the bracket 28 is made, so as to enable inwardly bent ears 85, 86 of the flanges to clear the vertical legs of the side channels 40, 42. When the rectangular frame is fully inserted into the channel these ears 85, 86 slip into the apertures formed by the inwardly bent tabs 69 in the channels 40, 42 and thereby lock the rectangular frame within the retainer bracket. When the rectangular frame 24 is fully inserted into the bracket 28, the overhanging lip 21 on the top of the front channel 41 of the rectangular frame 24 fits over the top edge 87 of the bracket 28 so as to assist in locking the rectangular frame to the retainer bracket. Thereby, the rectangular frame 24 is fixed to the retainer bracket 28 which is in turn fixed to the shelf.

Once the merchandiser 25 is secured to a shelf 17 it is ready to be loaded with merchandise such as bottles 32. This is done by placing the bottoms of the bottles over the top of the bumper wires 31 and against the front of any bottle already in the merchandiser. The bottom of the bottle is then moved rearwardly over the bumper wire by pushing any bottles in the merchandiser rearwardly. Once fully loaded the merchandiser may be left unattended so that customers may simply reach into the merchandiser and pull bottles from the front of the shelf. As a bottle is removed, the bottles immediately behind the removed bottle slide forwardly over the slip surface of the insert 27 until the forwardmost bottle of the column in which the bottle was removed, engages the top of the bumper wire 31 in that column.

Figure 8:
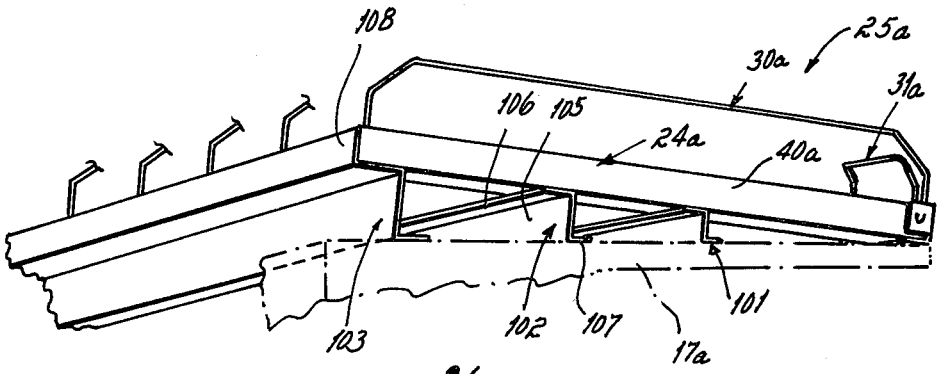
FIG. 8 is a perspective view of a second modification of merchandiser incorporating the invention of this application.
Figure 9:
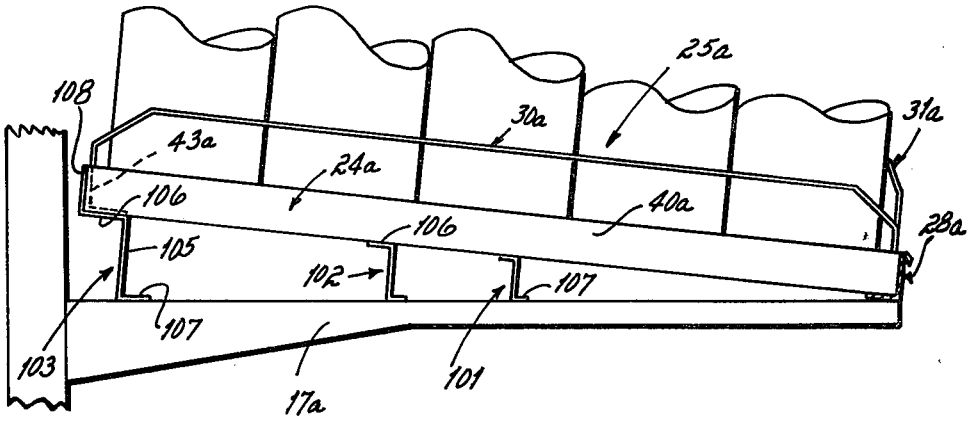
FIG. 9 is a side elevational view of the second modification of merchandiser illustrated in FIG. 8.

With reference now to FIGS. 8 and 9 there is illustrated a second preferred embodiment of this invention. This second embodiment is identical to that disclosed in FIGS. 1–7 except for the construction of the base frame 29 which is eliminated in this embodiment. Instead of the removable base frame 29, three vertical leg brackets 101, 102, and 103 are fixedly attached to the bottom of the rectangular frame. In all other regards this embodiment is identical to the embodiment illustrated in FIGS. 1–7. Therefore, those compartments which are identical have been given identical numerals except that in this second embodiment the numerical designation is followed by a suffix "a".

Each of the vertical leg brackets 101, 102 and 103 comprises a generally vertical section 105 from which there extends an upper generally horizontal flange 106 and a lower horizontal flange 107. The upper flange 106 is welded or otherwise fixedly secured to the bottoms of the side channels (only one of which, 40*a*, is illustrated) of the rectangular frame 24*a*.

The rearwardmost leg 103 has a second vertical section 108 which extends upwardly from the rearward edge of the top flange 106. This second vertical leg 108 may either lie in juxtaposition to the vertical leg of the rear channel 43 of the embodiment shown in FIGS. 1–7 or the rear channel 43*a* may be completely eliminated from the rectangular frame 24*a* and replaced by the rear leg bracket 108 as shown in FIGS. 8 and 9. In the event that the rear channel 43*a* is eliminated, the horizontal flange 106 and vertical leg 108 of the rear leg bracket 103 serve the same function as the rear channel 43*a* and form a portion of the rectangular frame 24*a* of the merchandiser.

All three bottom flanges 107 of the leg brackets 101, 102, and 103 are located in the same horizontal plane and are intended to support the merchandiser 25*a* upon a horizontal shelf 17*a*.

The primary difference between the embodiment illustrated in FIGS. 8 and 9 and the embodiment illustrated in FIGS. 1–7 is that this second embodiment requires the merchandiser 25*a* be shipped in the partially assembled condition since the leg brackets 101, 102 and 103 are welded to the bottom of the rectangular frame 24*a*. This increases the shipping cost of the overall assembly but the overall assembly is made more rigid without any appreciable increase in the total quantity of metal employed in the manufacture of the merchandiser.

The primary advantage of both embodiments of this merchandiser derives from their utility in converting a conventional horizontal shelf to a sloping shelf which is self-feeding. This invention enables shelves or display racks to be converted to self-feeding shelves or racks by the simple addition of the merchandiser without any modification of the shelf structure.

While I have described only a single preferred embodiment of my invention, persons skilled in the art to which this invention pertains will appreciate numerous changes and modifications which may be made without departing from the spirit of my invention. Therefore, I do not intend to be limited except by the scope of the following appended claims.

Having described my invention, I claim:

1. A merchandiser for converting a shelf having a generally horizontal top surface into a shelf having a downwardly and forwardly sloping top surface, said merchandiser being operable to gravity feed a column of items of merchandise one after another to the front of said shelf as that column's forwardmost item is removed by a customer, said merchandiser comprising, a generally wedge-shaped frame means, a stationary low friction slip surface member fixedly secured to said frame means so as to define a downwardly and forwardly sloping top surface on said wedge-shaped frame means, means for securing said frame means onto a horizontal shelf, and stop means located along the forward edge of said frame means for stopping merchandise displaced on the top of said low friction surface member from sliding forwardly off of said merchandiser.

2. The merchandiser of claim 1 wherein said low friction slip surface is defined by three ply corrugated plastic material.

3. The merchandiser of claim 2 in which the corrugations of said corrugated slip material extend from front to rear of said slip surface member and have vertical ridges defined in the top surface of said slip member parallel to said corrugations.

4. A merchandiser having a downwardly and forwardly sloping top surface, said merchandiser being operable to gravity feed a column of items of merchandise one after another to the front of a shelf as that column's forwardmost item is removed by a customer, said merchandiser comprising, a rectangular frame means, a stationary low friction slip surface member fixedly secured to said frame means so as to define the top surface of said frame means, said low friction slip surface member comprising a sheet of three ply corrugated plastic material, the corrugations of which extend from front to rear of said slip surface member and vertical ridges defined in the top surface of said slip surface member parallel to said corrugations, and said sheet of corrugated plastic material being transversely scored along the front and rear edges thereof, said sheet being folded about said score lines so as to locate the front and rear edge sections of said sheet in a vertical plane with the edges of said sheet facing upwardly.

5. The merchandiser of claim 4 in which said sheet of corrugated plastic material has vertically extending pockets in said vertical edge sections of said sheet, said pockets being defined between the corrugations of said corrugated plastic material and said pockets being open at said exposed edge, and a plurality of generally U-shaped wires having end sections extending downwardly from the opposite ends thereof, one end section of each of said wires extending downwardly into a pocket of said corrugated sheet of plastic material.

6. The merchandiser of claim 5 in which said plurality of generally U-shaped wires have one end located in a pocket of said front edge section of said sheet and the other end section extending into a pocket in the rear edge section of said sheet.

7. The merchandiser of claim 6 in which said plurality of generally U-shaped wires are equidistantly spaced across the width of said sheet.

8. The merchandiser of claim 6 in which both ends of said generally U-shaped wires extend downwardly into pockets located in the front edge section of said sheet, said U-shaped wires thereby forming the stop means located along the forward edge of said frame means.

9. A merchandiser for converting a shelf having a generally horizontal top surface into a shelf having a downwardly and forwardly sloping top surface, said merchandiser being operable to gravity feed a column of items of merchandise one after another to the front of said shelf as that column's forwardmost item is removed by a customer, said merchandiser comprising, a generally wedge-shaped frame means, a stationary low friction slip surface member fixedly secured to said frame means so as to define the top surface of said wedge-shaped frame means, means for securing said frame means onto a shelf, stop means located along the forward edge of said frame means for stopping merchandise displayed on the top of said low friction slip surface member from sliding forwardly off of said merchandiser, said frame means comprising a rectangular frame, each side of said rectangular frame being formed from a right angular channel-shaped element, and said frame means having a base secured to said rectangular frame, said base extending transversely between two opposite sides of said rectangular frame, said base having a first front vertical leg which is shorter in length than a parallel rear vertical leg, and means securing the tops of said vertical legs to the bottom of said rectangular frame.

10. A merchandiser for converting a shelf having a generally horizontal top surface into a shelf having a downwardly and forwardly sloping top surface, said merchandiser being operable to gravity feed a column of items of merchandise one after another to the front of said shelf as that column's forwardmost item is removed by a customer, said merchandiser comprising, a generally wedge-shaped frame means, a stationary low friction slip surface member fixedly secured to said frame means so as to define the top surface of said wedge-shaped frame means, means for securing said frame means onto a shelf, stop means located along the forward edge of said frame means for stopping merchandise displayed on the top of said low friction slip surface member from sliding forwardly off of said merchandiser, said frame means comprising a rectangular frame, each side of said rectangular frame being formed from a right angular channel-shaped element, each of said right angle channel shaped elements having a vertical leg and a horizontal leg, said slip surface member being supported upon said horizontal legs of said right angle channel shaped elements, and a retainer strip for securing said merchandiser onto a horizontal surface of a shelf, said retainer strip comprising a right angle channel having a horizontal leg and a vertical leg, means for securing said horizontal leg to a shelf, and means for securing said vertical leg of said strip to a vertical leg of at least one of the channels of said rectangular frame.

11. The merchandiser of claim 10 in which the forwardmost channel of said rectangular frame has a forwardly and downwardly bent lip along the top edge of the vertical leg of said channel, and said vertical leg of said retainer strip channel extends into a recess defined between said lip and the vertical leg of said forwardmost channel.

12. A merchandiser for converting a shelf having a generally horizontal top surface into a shelf having a downwardly and forwardly sloping top surface, said merchandiser being operable to gravity feed a column of items of merchandise one after another to the front of said shelf as that column's forwardmost item is removed by a customer, said merchandiser comprising, a generally wedge-shaped frame means, a stationary low friction slip surface member fixedly secured to said frame means so as to define the top surface of said wedge-shaped frame means, means for securing said frame means onto a shelf, and stop means located along the forward edge of said frame means for stopping merchandise displayed on the top of said low friction slip surface member from sliding forwardly off of said merchandiser, said low friction slip surface being defined by three ply corrugated plastic material, the corrugations of said corrugated slip material extending from front to rear of said slip surface member and having vertical ridges defined in the top surface of said slip member parallel to said corrugations, and said stop means comprising wires bent into U-shaped configuration, the ends of said wires being mounted within apertures defined in the front edge of said corrugated slip surface member.

13. A merchandiser for converting a shelf having a generally horizontal top surface into a shelf having a downwardly and forwardly sloping top surface, said merchandiser being operable to gravity feed a column of items of merchandise one after another to the front of said shelf as that column's forwardmost item is removed by a customer, said merchandiser comprising, a generally wedge-shaped frame means, a stationary low friction slip surface member secured to said frame means so as to define the top surface of said wedge-shaped frame means, means for securing said frame means onto a shelf, stop means located along the forward edge of said frame means for stopping merchandise displayed on the top of said low friction slip surface member from sliding forwardly off of said merchandiser, said frame means comprising a generally planar support, at least the front and rear sides of said planar support being formed from a right angular channel-shaped element, and said frame means including a base section secured to said planar support, said base section having a first front vertical section which is shorter in length than a parallel rear vertical section and means securing the tops of said vertical sections to said planar support.

14. The merchandiser of claim 13 in which each of said right angle channel-shaped elements has a vertical leg and a horizontal leg, and said slip surface member being supported upon said horizontal legs of said right angle channel-shaped elements.

15. The merchandiser of claim 13 which further includes a retainer strip for securing said merchandiser onto a horizontal surface of a shelf, said retainer strip comprising a right angle channel having a horizontal leg and a vertical leg, means for securing said horizontal leg to a shelf, and means for securing said vertical leg of said strip to a vertical leg of at least one of the channels of said planar support.

16. The merchandiser of claim 13 wherein said stop means comprises wires bent into a generally inverted U-shaped configuration, the ends of said wires being located across the front edge of said frame.

17. The merchandiser of claim 13 which further comprises organizer wires extending from the front to the back of said merchandiser, said organizer wires being spaced across the width of said merchandiser so as to define columns for the reception of items of merchandise across the width of said merchandiser.

18. A merchandiser for converting a shelf having a generally horizontal top surface into a shelf having a downwardly and forwardly sloping top surface, said merchandiser being operable to gravity feed a column of items of merchandise one after another to the front of said shelf as that column's forwardmost item is removed by a customer, said merchandiser comprising, a generally wedge-shaped frame means, a stationary low friction slip surface member secured to said frame means so as to define the top surface of said wedge-shaped frame means, means for securing said frame means onto a shelf, stop means located along the forward edge of said frame means for stopping merchandise displayed on the top of said low friction slip surface member from sliding forwardly off of said merchandiser, said frame means comprising generally a planar support, at least two sides of said planar support being formed from right angular channel-shaped elements, each of said right angle channel-shaped elements having a vertical leg and a horizontal leg, said slip surface member being supported upon said horizontal legs of said right angle channel-shaped elements, and securing means for securing said generally planar support in spaced sloping relation to a horizontal surface of a shelf, said securing means comprising a base support having a horizontal leg and a vertical leg, means for securing said horizontal leg of said base support to a shelf, and means for securing said vertical leg of said base support to said generally planar support.

19. A merchandiser for converting a shelf having a generally horizontal top surface into a shelf having a downwardly and forwardly sloping top surface, said merchandiser being operable to gravity feed a column of items of merchandise one after another to the front of said shelf as that column's forwardmost item is removed by a customer, said merchandiser comprising, a generally wedge-shaped frame means, a stationary low friction slip surface member fixedly secured to said frame means so as to define a downwardly and forwardly sloping top surface on said wedge-shaped frame means, means for securing said frame means onto a horizontal shelf, stop means located along the forward edge of said frame means for stopping merchandise displaced on the top of said low friction slip surface member from sliding forwardly off of said merchandiser, said frame means comprising a generally planar support, at least two sides of said planar support formed from a right angular channel-shaped element, each of said right angle channel-shaped elements having a vertical leg and a horizontal leg, and said slip surface being supported upon said horizontal legs of said right angle channel-shaped elements.

* * * * *

UNITED STATES PATENT AND TRADEMARK OFFICE

CERTIFICATE OF CORRECTION

PATENT NO. : 4,461,388

DATED : July 24, 1984

INVENTOR(S) : Rafael T. Bustos

It is certified that error appears in the above-identified patent and that said Letters Patent is hereby corrected as shown below:

Col. 7, line 12, "compartments" should be -- components --

Col. 12, line 27, after "support" insert -- being --

Signed and Sealed this

*Twenty-third* Day of *April 1985*

[SEAL]

*Attest:*

DONALD J. QUIGG

*Attesting Officer*

*Acting Commissioner of Patents and Trademarks*